United States Patent [19]

Avny

[11] Patent Number: 4,692,962

[45] Date of Patent: Sep. 15, 1987

[54] CONCEALED MOUNTED PUSH BARS AND GRILLS

[76] Inventor: Sam Avny, 44 Holmes Pl., Fredonia, N.Y. 14063

[21] Appl. No.: 821,116

[22] Filed: Jan. 21, 1986

Related U.S. Application Data

[63] Continuation of Ser. No. 629,888, Jul. 11, 1984, abandoned.

[51] Int. Cl.[4] ..... A47H 33/00

[52] U.S. Cl. ..... 16/111 R; 16/DIG. 5; 16/DIG. 7

[58] Field of Search ..... 16/111 R, DIG. 5, DIG. 7, 16/DIG. 31, DIG. 41

[56] References Cited

U.S. PATENT DOCUMENTS

| | | | |
|---|---|---|---|
| 1,145,471 | 7/1915 | Dobrick | 16/111 R |
| 1,682,375 | 8/1928 | Heidt | 16/DIG. 5 |
| 1,814,317 | 7/1931 | Lebherz | 16/DIG. 5 |
| 1,860,780 | 5/1932 | Kees | 16/1 R |
| 1,928,149 | 9/1933 | De Wees | 40/125 |
| 1,961,480 | 6/1934 | De Wees | 16/124 |
| 2,048,735 | 7/1936 | Erickson | 40/125 |
| 2,078,478 | 4/1937 | Allen | 40/125 |
| 2,095,463 | 10/1937 | Wren | 20/39 |
| 2,225,211 | 12/1940 | Erickson | 16/1 |
| 2,555,783 | 6/1951 | Bryson | 16/1 |
| 2,576,511 | 11/1951 | Jewett | 16/1 |
| 2,582,526 | 1/1982 | Burdick | 16/1 |
| 2,589,516 | 3/1952 | Stelzer | 16/111 R |
| 2,870,493 | 1/1959 | Beyrie | 20/16 |
| 4,087,141 | 5/1978 | Roberts | 16/110 R |
| 4,514,877 | 5/1985 | Peroni | 16/111 R |

*Primary Examiner*—Paul A. Bell
*Assistant Examiner*—James L. Wolfe
*Attorney, Agent, or Firm*—Carothers & Carothers

[57] ABSTRACT

A push bar assembly or the like having a plurality of bars retained by extruded mounting members which receive the ends of the bars whereby the mounting members may be secured in fixed, spaced relationship to a structure to captively retain the bars, and further having cover or cap elements which are retained with respect to the bars and the mounting members to conceal both the ends of the captively retained bars and the securing elements by which the mounting members are secured in fixed, spaced relationship.

8 Claims, 5 Drawing Figures

CONCEALED MOUNTED PUSH BARS AND GRILLS

This is a continuation of co-pending application Ser. No. 629,888 filed on July 11, 1984, now abandoned.

In such arts as door hardware is well known to provide a push bar structure for mounting on a hinged door. The push bar structure preferably may provide a hand hold for either pushing or pulling the door to open and close same, and in addition may serve to shield parts of the door, such as the screen in a screen door, from damage. Other push bar arrangements have included structure for display of a sign such as an advertisement or warning.

The prior art is replete with examples of such push bar structures. For example, U.S. Pat. No. 2,589,516 relates to a push bar structure wherein the opposite ends of an elongated push bar are received into retaining bores in bar mounting assemblies which are, in turn, secured to opposite sides of a door. The design of the assembly serves to hide all fasteners by which the assembly is secured to the door. Other push bar, guard, grille, and pull handle structures are disclosed in U.S. Pat. Nos. 1,145,471, 1,682,375, 1,814,317, 1,860,780, 1,928,149, 1,961,480, 2,048,735, 2,095,463, 2,078,478, 2,225,211, 2,555,783, 2,576,511, 2,582,526 and 2,870,493.

The present invention pertains to a push bar or the like comprised of plural bars extending between and captively retained by extruded members which preferably are identical and which serve to secure the bars with respect to a door, a window or other structure. The invention thus may be utilized as a push or pull bar, a protective guard for a door or window, a decorative grille structure, or the like. The invention also contemplates a cover or cap which serves to provide a suitably finished appearance for the push bar structure as well as hiding all fasteners by which the structure is secured together and fastened to the door or window.

Another alternate securing arrangement of the push bar or grill can be achieved by the use of double-face permanent tape, which will eliminate the drilling and fastening procedures.

It is therefore one general object of the invention to provide a new and improved door push bar or similar structure.

Another more specific object of the invention is to provide a door push bar or the like having elongated elements secured with respect to extended mounting elements which are preferably identical.

A further specific object of the invention is to provide a door push bar or like structure comprised of plural, coextensive bar elements whose opposite ends are captively retained by extruded mounting members which are, in turn, affixed to the door by fasteners, these mounting fasteners being the only fasteners utilized in the assembly and being concealed by a cover member to provide a finished appearance in a comparatively inexpensive and simple structure.

Other objects and advantages of this invention appear in the following description and claims.

The accompanying drawings show, for the purpose of exemplification without limiting the invention or claims thereto, certain practical embodiments illustrating the principles of the invention wherein:

Figure 1:
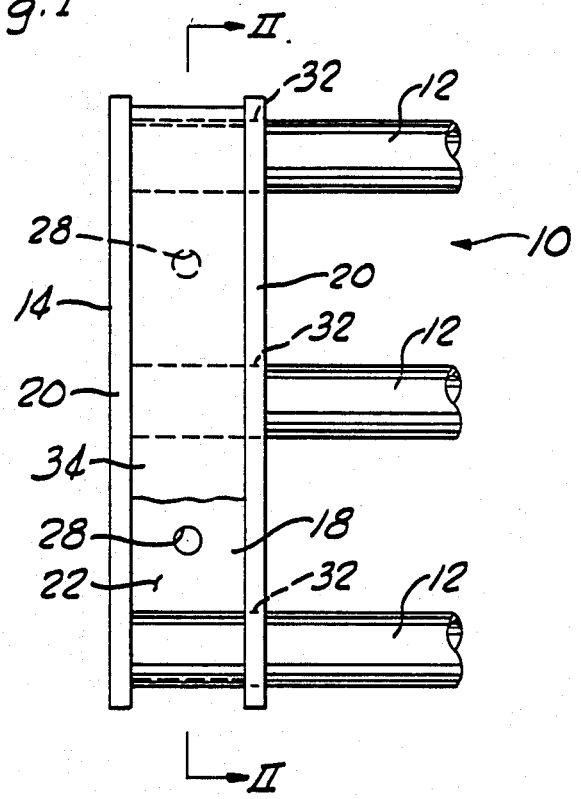
FIG. 1 is a fragmentary side elevation, partially broken away, of a push bar structure of the present invention.
Figure 2:
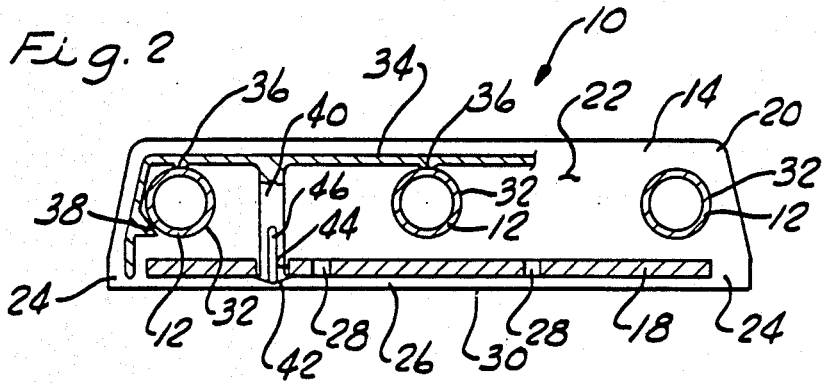
FIG. 2 is a sectional view taken on line II—II of FIG. 1.

There is generally indicated at 10 in FIGS. 1 and 2 a push bar assembly according to one presently preferred embodiment of the instant invention and including a plurality of elongated bars 12, preferably three tubular metal rods for the embodiment shown, of identical, predetermined length, which are captively retained adjacent their opposite ends by an extruded mounting member 14. In FIG. 1 only one end portion of the push bar assembly 10 is shown inasmuch as the opposite end portion, and the bars 12 extending therebetween, are identical to the elements illustrated.

The mounting member 14 is an elongated extrusion, preferably of aluminum, and comprising an elongated base portion 18 having mutually parallel, upstanding flange portions 20 affixed to the opposite longitudinal sides thereof to form an elongated recess 22. The flanges 20 extend longitudinally beyond the ends of base portion 18 as at 24 and also behind the base portion as at 26.

The base portion 18 is provided with through bores 28 to receive mounting fasteners (not shown) for securing the mounting member 14 to a door or window. For example, suitable threaded fasteners may be passed through bores 28 and into the door or window such that the mounting member 14 is secured with the rearward edges 30 of flanges 20 in firm surface contact with the door or window. Alternatively, a pair of the assemblies 10 may be mounted in mutually aligned orientation on opposite sides of a door by passing suitable fasteners such as bolts (not shown) through the aligned bores 28 and through the door therebetween and securing same with a nut tightly threaded onto the bolt. To provide for captive retention of the bars 12, one flange 20 of each mounting member 14 is provided with apertures 32, each of whih receives one end of a respective bar 12. Each end of a bar 12 thus is passed through one of apertures 32 and into recess 22 and is maintained in abutting contact with the other flange portion 20 of the same mounting member 14. Thus, when the mounting members 14 are affixed to a door with the bars 12 in place, the bars 12 are captively retained and are secured against axial sliding.

In order to provide a professional, finished appearance for the assembly 10, a finish cap 34 is provided to cover recess 22. Accordingly, cap 34 is comprised of a member of a width corresponding to the width of recess 22 and formed to coincide generally with the outer profile of flange portions 20 as shown in FIG. 2. For additional finish and for decoration, a suitable design may be applied to the outer surface of cap 34. For example, cap 34 may be of molded plastic with a molded-in design, but preferably is an extruded aluminum member with an embossed etched, stamped, painted or anodized finish and/or surface design.

For positioning and retention of cap 34, contact ridges or dimples 36 may be provided on the inner surface thereof to contact respective bars 12. An inclined Tab 38 may be provided adjacent each end of the cover member 34 to interlock under the adjacent rods 12 for spring biased retention of cover 34. In addition to or in lieu of tabs 38, cover 34 may be provided with one or more retention posts 40 having an interlocking tab structure 42 adjacent the free end thereof to interlock within a cooperably located aperture 44 in base portion 18. The tab structure 42 may include single or multiple pronged tabs and suitable means to permit deformation and biased spring back of the tabs upon passing same into and through apertures 44. For example, a split post, as at 46, may be employed. The cap 34 conceals the mounting fasteners and the retained ends of bars 12 with a decorative element to offer a professional, finished appearance.

Figure 3:
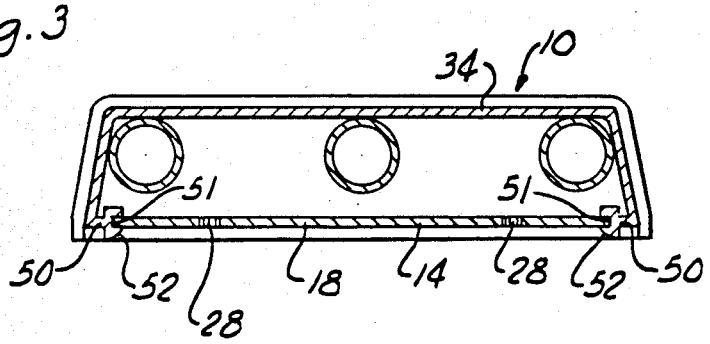
FIG. 3 is a sectional view similar to FIG. 2 of an alternative embodiment of the invention.

An alternative structure for securing cap 34 to mounting member 14 is shown in FIG. 3 as including formed snap-on structures 50 located adjacent the lower inner ends of cap 34, each having a groove 51 that receives an end of base portion 18 and a lower, lip 52, which permits the cap 34 to be installed by manual pressure causing lip 52 to override the respective end of base portion 18. As this occurs, cap 34 is resiliently deformed outward and then resiles inward again to nearly its original form to thereby exert an inward bias which continuously urges structures 50 against base portion 18 and thus reforms the respective ends of base portion 18 in grooves 51.

Two additional features serve to illutrate the versatility of the instant invention. First, the bars 12 may be supplied to the end user, whether a tradesman or home handyman, in a length corresponding to a maximum door width, and may be readily trimmed with a hacksaw, tube cutter or the like to a suitable length for the installation contemplated. Thus, a single component package will suffice for installations of widely differing critical dimensions. As the ends of the rods 12 will be concealed in the finished assembly, the rod end cutoff operation need not be skillfully done or clean. Furthermore, within limits, the rods 12 need not be of the same length since the captive retention point is preferably spaced from the rod end. Unequal rod lengths may result in undesirable axial sliding of one or more rods, but the rods still would be captivley retained. The second feature concerns the versatility of color and/or finish coordination available in the described components. By offering separately selected colors or finishes for rods, mounting members, and caps, appealing and decorative color coordination may be readily achieved by the end user.

Figure 4:
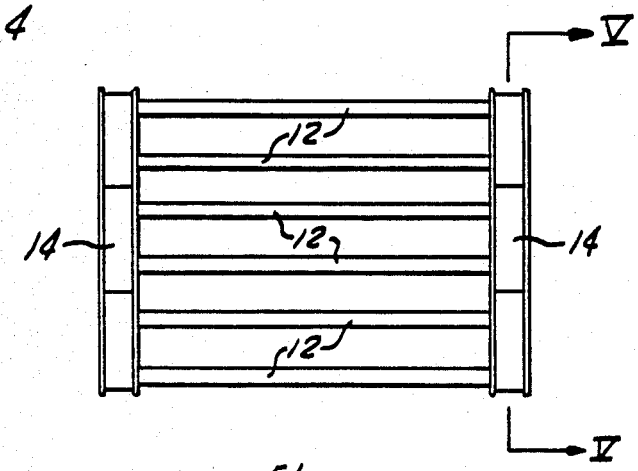
FIG. 4 is an elevation of another embodiment of the invention.
Figure 5:
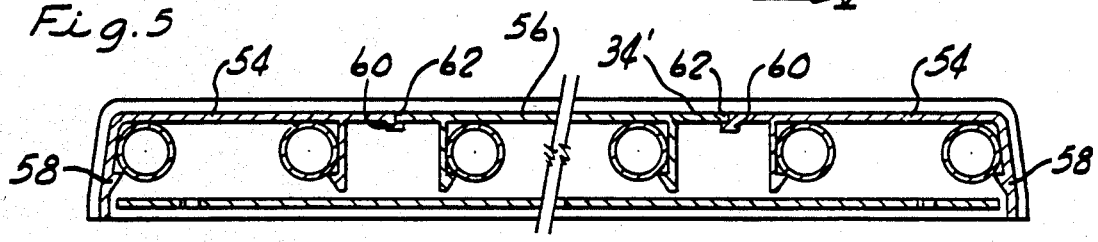
FIG. 5 is a sectional view taken on line V—V of FIG. 4.

Of course, other embodiments of the invention are contemplated. For example, in FIGS. 4 and 5 there is shown an embodiment of the invention which is similar to the above described embodiment in every salient detail except that it is not limited to only three tiers. Specifically, the embodiment of FIG. 4 has 6 bars 12 mounted in elongated end mounting members 14 in precisely the same manner as above described.

For this embodiment a cap 34' is comprised of plural cap elements 54, 56, mounted in abutting end-to-end relationship to conceal the mounting of member 14 as above described and having the other end 60 thereof in abutment with the respective end 52 of intermediate cap element 56. The respective abutting ends 60, 62 of cap elements 54, 56, may be suitably formed for interlocking engagement or other modes of endwise engagement.

According to the description hereinabove, the instant invention provides for a novel door push bar structure or the like which offers improved versatility of application and wider selection of appearance options in a simple and therefore inexpensive structure. The professional finish and appearance, as well as the range of appearance selection available to the user, approach levels heretofore available only in considerably more complex and expensive systems which have been intended for prefessional or trade use.

Of course, it is to be appreciated that the inventor has considered numerous alternative and modified embodiments of the invention. For example, the bars 12 need not be circular in cross section and may be more or fewer than three in number; the profile of flanges 20 may be modified within a latitude of design; the specific form and mode of retention for cover 34 may be varied as by substituting a formed locater saddle for the ridges 36 to cooperate with rods 12 and thus locate cover 34 with respect thereto; additional bar support may be provided intermediate the ends of bars 12 by one or more additional mounting members having aperture in both of its flanges 20. Furthermore, other decorative elements in addition to the caps 34 may be mounted on bars 12 intermediate the mounting members 14.

These and other embodiments and modifications having been envisioned and anticipated by the inventor, the invention is to be construed as broadly as permitted by the scope of the claims appended hereto.

I claim:

1. A push bar assembly comprising:

a plurality of elongated coextensive bars;

a pair of unitary mounting members which receive respective opposite axial ends of said bars;

each of said mounting members comprising an elongated base portion adapted to be positioned adjacent a mounting surface and a pair of upstanding flange portions extending longitudinally of said base portion adjacent the opposite longitudinal sides thereof and projecting from said base portion to form therebetween a frontally open elongated recess with said base portion forming a bottom portion of said recess;

plural aperture means formed in one of said flange portions of each said mounting member; each said aperture means receiving a respective axial end of one of said bars in a manner to secure said bars in fixed spaced relationship; the other of said flange portions of each said mounting member forming abutment means for abutting engagement with the respective axial ends of said bars in a manner to secure said bars in fixed longitudinal relationship with the longitudinal ends thereof extending transversely of said recess;

fastener receiving aperture means formed in the respective base portions of said mounting members intermediate the respective said flanges and oriented to receive axially therein via said frontally open recess mounting fasteners for securing said mounting members to such a mounting surface in fixed, spaced relationship to thereby captively retain said bars;

a formed cap means which is cooperable with each said mounting member to cover said frontally open recess and thereby conceal said axial ends of said bars and the mounting fasteners;

each said cap means includes a retention means which cooperates with at least some of said bars to retain said cap means with respect to the respective said mounting member; and wherein said retention means includes tab means located to interlock under said at least some of said bars intermediate said flanges for biased releasable retention of said cap means with respect to said mounting member.

2. The push bar assembly of claim 1 wherein said retention means additionally includes formed means which is engageable with said bars to locate said cap means with respect to said flanges.

3. The push bar assembly of claim 2 wherein said cap means includes decorative design means applied to an exposed surface portion thereof.

4. The push bar assembly of claim 3 wherein said bars are cylindrical bars.

5. The push bar assembly of claim 4 wherein said plurality of bars is three bars.

6. The push bar assembly of claim 1 wherein each said retention means is operable to retain said cap means intermediate said flanges with respect to the respective said mounting member.

7. The push bar assembly of claim 6 wherein said retention means includes a formed contact means which is engageable with said at least some of said bars to locate each said cap means with respect to said respective mounting member.

8. The push bar assembly as claimed in claim 1 wherein said cap means includes plural cap elements which are secured with respect to said mounting member in abutting end-to-end relationship.

* * * * *